US011639714B2

(12) United States Patent
Tanaka

(10) Patent No.: US 11,639,714 B2
(45) Date of Patent: May 2, 2023

(54) PUMP DEVICE

(71) Applicant: Murata Manufacturing Co., Ltd., Kyoto (JP)

(72) Inventor: Nobuhira Tanaka, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 268 days.

(21) Appl. No.: 16/999,708

(22) Filed: Aug. 21, 2020

(65) Prior Publication Data

US 2020/0378373 A1 Dec. 3, 2020

Related U.S. Application Data

(63) Continuation of application No. PCT/JP2019/005337, filed on Feb. 14, 2019.

(30) Foreign Application Priority Data

Apr. 19, 2018 (JP) ..... JP2018-080808

(51) Int. Cl.
*F04B 17/00* (2006.01)
*F04B 23/04* (2006.01)

(52) U.S. Cl.
CPC ..... *F04B 17/003* (2013.01); *F04B 23/04* (2013.01)

(58) Field of Classification Search
CPC ..... F04B 17/003; F04B 23/04
See application file for complete search history.

(56) References Cited

U.S. PATENT DOCUMENTS 6,400,066 B1 * 6/2002 Sumrak ..... F02M 61/167 239/102.1
2003/0215342 A1 11/2003 Higashino et al.
2005/0219302 A1 * 10/2005 Vogeley ..... H01L 41/042 347/19
2009/0015097 A1 * 1/2009 Meng ..... H02N 2/14 318/116
2010/0268407 A1 10/2010 Yanagisawa
2012/0265125 A1 * 10/2012 Kawamura ..... A61M 5/145 604/67

FOREIGN PATENT DOCUMENTS

CN 101864785 A 10/2010
JP 2003320020 A 11/2003
JP 2004169706 A 6/2004

OTHER PUBLICATIONS

International Search Report issued in Application No. PCT/JP2019/005337, dated May 21, 2019.
Written Opinion issued in Application No. PCT/JP2019/005337, dated May 21, 2019.

* cited by examiner

*Primary Examiner* — Connor J Tremarche
(74) *Attorney, Agent, or Firm* — Pearne & Gordon LLP

(57) ABSTRACT

A pump device includes a first piezoelectric pump, a second piezoelectric pump connected in series to the first piezoelectric pump on an upstream side of the first piezoelectric pump, a driver unit that supplies alternating-current input power to the first piezoelectric pump and the second piezoelectric pump, and a distribution setting unit that sets a distribution ratio of the input power to be supplied from the driver unit to each of the first piezoelectric pump and the second piezoelectric pump, wherein the distribution setting unit sets a ratio of the input power for the second piezoelectric pump to the input power for the first piezoelectric pump to a value greater than 1 and equal to or less than 1.57.

20 Claims, 6 Drawing Sheets

FIG. 2

| AMBIENT TEMPERATURE [°C] | INPUT POWER [W] | | TEMPERATURE [°C] | | POWER RATIO | CURRENT RATIO | HIGHER OF TWO PUMPS' TEMPERATURE [°C] | FLOW RATE [L/min] | INTERNAL PRESSURE [kPa] | |
|---|---|---|---|---|---|---|---|---|---|---|
| | FIRST PUMP | SECOND PUMP | FIRST PUMP | SECOND PUMP | | | | | FIRST PUMP | SECOND PUMP |
| 50 | 1.98 | 1.80 | 104.4 | 90.3 | 0.91 | 0.95 | 104.4 | 0.6 | 10.5 | 9.5 |
| | 1.89 | 1.89 | 101.9 | 92.4 | 1.00 | 1.00 | 101.9 | 0.6 | 10 | 10 |
| | 1.8 | 1.98 | 99.5 | 94.4 | 1.10 | 1.05 | 99.5 | 0.6 | 9.5 | 10.5 |
| | 1.71 | 2.07 | 97 | 96.4 | 1.21 | 1.10 | 97.0 | 0.6 | 9.0 | 11.0 |
| | 1.59 | 2.19 | 93.7 | 99.1 | 1.38 | 1.17 | 99.1 | 0.6 | 8.4 | 11.6 |
| | 1.47 | 2.31 | 90.4 | 101.8 | 1.57 | 1.25 | 101.8 | 0.6 | 7.8 | 12.2 |
| | 1.38 | 2.40 | 87.9 | 103.8 | 1.74 | 1.32 | 103.8 | 0.6 | 7.3 | 12.7 |

PUMP DEVICE

This is a continuation of International Application No. PCT/JP2019/005337 filed on Feb. 14, 2019 which claims priority from Japanese Patent Application No. 2018-080808 filed on Apr. 19, 2018. The contents of these applications are incorporated herein by reference in their entireties.

BACKGROUND OF THE DISCLOSURE

Field of the Disclosure

The present disclosure relates to pump devices.

Description of the Related Art

Until now, pump devices for moving fluids such as air and the like have been disclosed (for example, see Patent Document 1).

The pump device in the Patent Document 1 is a pump device in which a plurality of piezoelectric pumps are connected in series. This pump device drives respective ones of a plurality of piezoelectric pump in such a way that the input power is supplied to adjacent piezoelectric pumps with a phase difference. This enables to alleviate pressure pulsation in the case where a plurality of piezoelectric pumps are connected in series.

The piezoelectric pump used in the pump device of the Patent Document 1 has a structure in which a piezoelectric element is bonded onto a metal plate and moves air by supplying alternating-current power to this structure to cause bending deformation in unimorph mode.

Patent Document 1: Japanese Unexamined Patent Application Publication No. 2004-169706

BRIEF SUMMARY OF THE DISCLOSURE

The piezoelectric pump causes bending deformation of the piezoelectric element and the metal plate at high speed, and thus compared with pumps of other types, the rate of pump temperature increase is higher. When the temperature of the pump increases above the upper-temperature limit, there is a possibility of pump failure. As a result, the reliability of pump device may decrease.

In particular, in the case where the piezoelectric pumps are connected in series, high-temperature air heated at a piezoelectric pump on the upstream side is supplied to a piezoelectric pump on the downstream side, and thus the temperature of the piezoelectric pump on the downstream side is prone to increase. Therefore, in the case where the piezoelectric pumps are connected in series, it is highly possible that the temperature of a pump on the downstream side increases above the pump's upper-temperature limit, thereby causing a failure of the pump on the downstream side. As a result, the reliability of pump device may decrease.

Accordingly, an object of the present disclosure is to resolve the foregoing problem and to provide a pump device with improved reliability.

In order to achieve the foregoing object, a pump device according to the present disclosure includes: a first piezoelectric pump; a second piezoelectric pump connected in series to the first piezoelectric pump on an upstream side of the first piezoelectric pump; a driver unit that supplies alternating-current input power to the first piezoelectric pump and the second piezoelectric pump; and a distribution setting unit that sets a distribution ratio of the input power to be supplied from the driver unit to each of the first piezoelectric pump and the second piezoelectric pump, wherein the distribution setting unit sets a ratio of the input power for the second piezoelectric pump to the input power for the first piezoelectric pump to a value greater than 1 and equal to or less than 1.57.

Further, a pump device of the present disclosure includes: a first piezoelectric pump; a second piezoelectric pump connected in series to the first piezoelectric pump on an upstream side of the first piezoelectric pump; a driver unit that supplies alternating-current input power to the first piezoelectric pump and the second piezoelectric pump; and a distribution setting unit that sets a distribution ratio of an input current value to be supplied from the driver unit to each of the first piezoelectric pump and the second piezoelectric pump, wherein the distribution setting unit sets a ratio of the input current value for the second piezoelectric pump to the input current value for the first piezoelectric pump to a value greater than 1 and equal to or less than 1.25.

The pump device of the present disclosure enables to prevent a series-connected piezoelectric pumps from becoming excessively high temperature and to improve the reliability of the pump device.

BRIEF DESCRIPTION OF THE SEVERAL VIEWS OF THE DRAWINGS

FIG. 2 is a diagram illustrating conditions and results of a working example 1 implemented using the pump device of FIG. 1.

DETAILED DESCRIPTION OF THE DISCLOSURE

Figure 1:
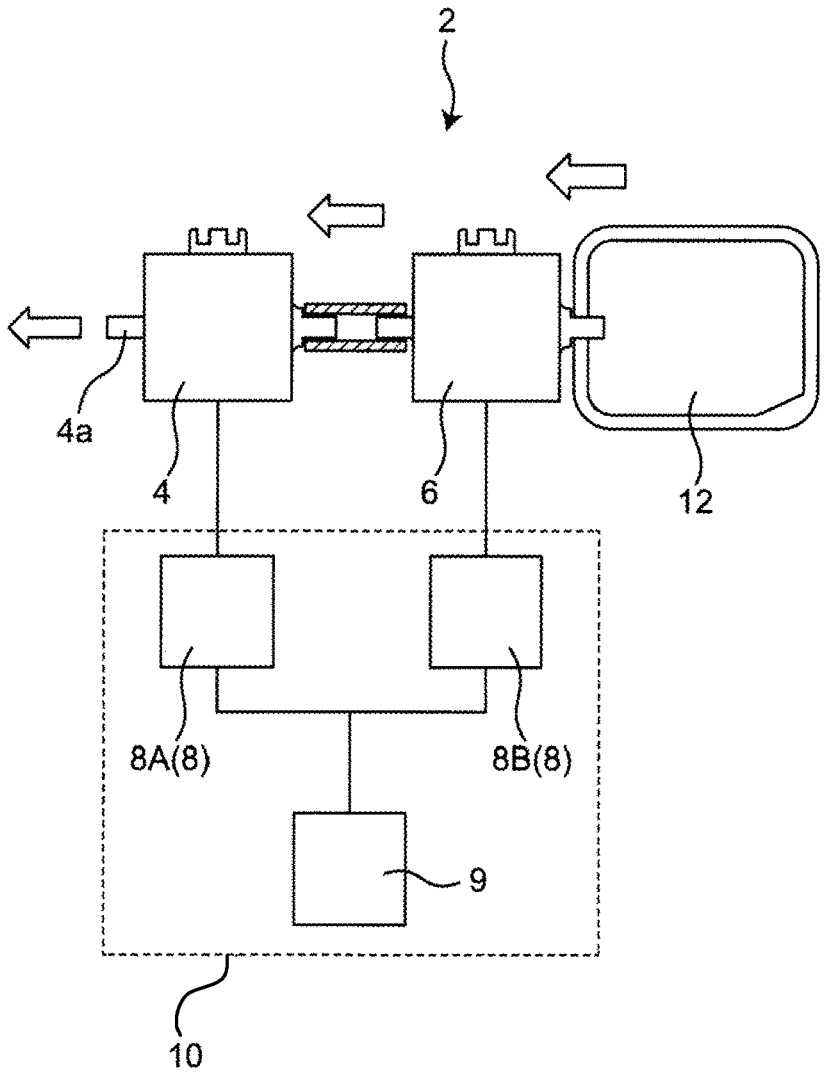
FIG. 1 is a diagram illustrating a schematic configuration of a pump device.

According to the first aspect of the present invention, a pump device is provided. The pump device includes: a first piezoelectric pump; a second piezoelectric pump connected in series to the first piezoelectric pump on an upstream side of the first piezoelectric pump; a driver unit that supplies alternating-current input power to the first piezoelectric pump and the second piezoelectric pump; and a distribution setting unit that sets a distribution ratio of the input power to be supplied from the driver unit to each of the first piezoelectric pump and the second piezoelectric pump, wherein the distribution setting unit sets a ratio of the input power for the second piezoelectric pump to the input power for the first piezoelectric pump to a value greater than 1 and equal to or less than 1.57.

Such configuration enables to suppress the temperature increase of the first piezoelectric pump relative to the temperature increase of the second piezoelectric pump and to balance the heat generation of the first piezoelectric pump and the heat generation of the second piezoelectric pump. This enables to suppress a risk that the temperature of any of the piezoelectric pumps becomes equal to or higher than the upper-temperature limit and to suppress the occurrence of failure of the piezoelectric pump, thereby enabling the improvement of reliability of the pump device.

According to the second aspect of the present invention, there is provided the pump device according to the first aspect wherein the first piezoelectric pump and the second piezoelectric pump have a same rated output. According to such configuration, by setting the input power in the manner described above and balancing the heat generation of the first piezoelectric pump and the heat generation of the second piezoelectric pump, it becomes possible to further suppress the risk that the temperature of any of the piezoelectric pumps becomes equal to or higher than the upper-temperature limit and to further improve the reliability of the pump device.

According to the third aspect of the present invention, there is provided the pump device according to the first aspect and the second aspect, wherein the distribution setting unit sets the ratio of the input power for the second piezoelectric pump to the input power for the first piezoelectric pump to a value between 1.1 and 1.38 inclusive. According to such configuration, by further balancing the heat generation of the first piezoelectric pump and the heat generation of the second piezoelectric pump, it becomes possible to further suppress the risk that the temperature of any of the piezoelectric pumps becomes equal to or higher than the upper-temperature limit and to further improve the reliability of the pump device.

According to the fourth aspect of the present invention, a pump device is provided. The pump device includes: a first piezoelectric pump; a second piezoelectric pump connected in series to the first piezoelectric pump on an upstream side of the first piezoelectric pump; a driver unit that supplies alternating-current input power to the first piezoelectric pump and the second piezoelectric pump; and a distribution setting unit that sets a distribution ratio of an input current value to be supplied from the driver unit to each of the first piezoelectric pump and the second piezoelectric pump, wherein the distribution setting unit sets a ratio of the input current value for the second piezoelectric pump to the input current value for the first piezoelectric pump to a value greater than 1 and equal to or less than 1.25. Such configuration enables to suppress the temperature increase of the first piezoelectric pump relative to the temperature increase of the second piezoelectric pump and to balance the heat generation of the first piezoelectric pump and the heat generation of the second piezoelectric pump. This enables to further suppress the risk that the temperature of any of the piezoelectric pumps becomes higher than the upper-temperature limit and to suppress the occurrence of failure of the piezoelectric pump, thereby enabling the improvement of reliability of the pump device.

According to the fifth aspect of the present invention, there is provided the pump device according to the fourth aspect wherein the distribution setting unit sets the ratio of the input current value for the second piezoelectric pump to the input current value for the first piezoelectric pump to a value between 1.05 and 1.17 inclusive. According to such configuration, by balancing the heat generation of the first piezoelectric pump and the heat generation of the second piezoelectric pump, it becomes possible to further suppress the risk that the temperature of any of the piezoelectric pumps becomes equal to or higher than the upper-temperature limit and to further improve the reliability of the pump device.

EMBODIMENTS

Hereinafter, embodiments according to the present disclosure are described in detail with reference to the drawings.

<Configuration Overview>

FIG. 1 is a diagram illustrating a schematic configuration of a pump device 2 in one embodiment.

The pump device 2 illustrated in FIG. 1 includes a first piezoelectric pump 4, a second piezoelectric pump 6, a driver unit 8, a control device 9, and a distribution setting unit 10. The second piezoelectric pump 6 is connected to a suction target 12.

The first piezoelectric pump 4 and the second piezoelectric pump 6 are pumps that are connected to each other in series. The first piezoelectric pump 4 is arranged on the downstream side, and the second piezoelectric pump 6 is arranged on the upstream side. No pump is provided between the first piezoelectric pump 4 and the second piezoelectric pump 6, and the first piezoelectric pump 4 and the second piezoelectric pump 6 are directly connected to each other.

The first piezoelectric pump 4 and the second piezoelectric pump 6 in the present embodiment are piezoelectric pumps each using a piezoelectric element (the piezoelectric pump may also be referred to as "micro blower", "micro pump", or the like). Specifically, the piezoelectric pump has a structure in which a piezoelectric element (not illustrated) is bonded onto a metal plate (not illustrated) and moves air by supplying alternating-current power to the piezoelectric element and the metal plate and causing unimorph mode bending deformation. In such piezoelectric pumps, a diaphragm (not illustrated) functioning as a valve that limits the flow of air in one direction.

Furthermore, in the present embodiment, as the first piezoelectric pump 4 and the second piezoelectric pump 6, piezoelectric pumps having the same specifications are used. The first piezoelectric pump 4 and the second piezoelectric pump 6 are manufactured by the same manufacturer, have the same part number, and have the same parameters such as the rated output (namely, flow rate per unit time), the size, and the like. At the time of checking the part number, the rated output, and the like, a catalog published by a manufacturer or a seller of the piezoelectric pumps, or a product specification document entered into between a customer and a manufacturer or a seller of the piezoelectric pumps, or the like may be used. By having the same specifications, the first piezoelectric pump 4 and the second piezoelectric pump 6 have the same level of heat generating property when the same input power is supplied (that is to say, the rate of temperature increase per unit time is at the same level).

The driver unit 8 is a battery that supplies input power to the first piezoelectric pump 4 and the second piezoelectric pump 6. In the present embodiment, the driver unit 8 includes a first driver unit 8A and a second driver unit 8B. The first driver unit 8A supplies input power to the first piezoelectric pump 4, and the second driver unit 8B supplies input power to the second piezoelectric pump 6.

The driver unit 8 of the present embodiment supplies alternating-current input power to the first piezoelectric pump 4 and the second piezoelectric pump 6. By being driven with the alternating-current input power, the piezoelectric elements of the first piezoelectric pump 4 and the second piezoelectric pump 6 are caused to have unimorph mode bending deformation.

The driver unit 8 is connected to the control device 9. The control device 9 is a member that controls each of the first driver unit 8A and the second driver unit 8B. Specifically, the control device 9 controls the power, the voltage, the current, and the like to be inputted from the driver unit 8 to each of the first piezoelectric pump 4 and the second piezoelectric pump 6. The control device 9 is, for example, made up of a micro controller unit (MCU).

In the present embodiment, the driver unit 8 and the control device 9 constitute the distribution setting unit 10. The distribution setting unit 10 has a function to set the distribution ratios of input power to be supplied from the driver unit 8 to the respective ones of the first piezoelectric pump 4 and the second piezoelectric pump 6. The distribution setting unit 10 is not limited to the one including the control device 9 and may alternatively be a device in which the input voltage is set by a resistor or may be a device in which a step-up ratio is set. Any type of a distribution setting unit 10 may be used, provided that the distribution setting unit 10 has the function to set the distribution ratio of input power.

The distribution setting unit 10 of the present embodiment may alternatively be a device that has a function to set the distribution ratio of "input current value". The input current value is a parameter approximately proportional to the deformation speed of a piezoelectric element of the piezoelectric pump. Adjusting the input current value enables to adjust the deformation speed of the piezoelectric element and prevents pump failure.

The suction target 12 is a target object from which air is suctioned by the second piezoelectric pump 6 of the pump device 2. The suction target 12 may be, for example, a breast pump, a nasal aspirator, or any other suction target. A fluid of suction target is air. However, the fluid of suction target may be any fluid other than air.

A negative pressure is created in the inside of the suction target 12 by suctioning air from the suction target 12 using the pump device 2. The pump device 2 having such configuration functions as a so-called "negative pressure pump".

According to the configuration of pump device 2 described above, input power is supplied from the first driver unit 8A and the second driver unit 8B to the first piezoelectric pump 4 and the second piezoelectric pump 6, respectively. Upon receiving supply of the input power, the first piezoelectric pump 4 and the second piezoelectric pump 6 are driven and cause bending deformation of the piezoelectric elements at high speed, thereby moving air.

The second piezoelectric pump 6 suctions air from the suction target 12, pressurizes the suctioned air in the inside, and supplies the pressurized air to the first piezoelectric pump 4. Air suctioned by the first piezoelectric pump 4 is further pressurized in the inside the first piezoelectric pump 4, and the pressurized air is emitted to the outside through an exhaust outlet 4*a*.

In the foregoing operation, the temperatures of the first piezoelectric pump 4 and the second piezoelectric pump 6 increase during the step of pressurizing the air in the inside thereof. For example, in the case where the first piezoelectric pump 4 and the second piezoelectric pump 6 are both driven at an input power of 1.9 W, when the second piezoelectric pump 6 suctions, for example, air of 50° C. from the suction target 12, the suctioned air is heated up to, for example, about 60° C. This air is then suctioned by the first piezoelectric pump 4 and is emitted from the exhaust outlet 4*a* after being heated up to, for example, about 70° C. in the inside of the first piezoelectric pump 4.

As described above, when air is supplied from the second piezoelectric pump 6 on the upstream side to the first piezoelectric pump 4 on the downstream side, the air heated in the second piezoelectric pump 6 is supplied to the first piezoelectric pump 4. Accordingly, the temperature of the first piezoelectric pump 4 is likely to be higher than the temperature of the second piezoelectric pump 6.

Whereas, in the present embodiment, the distribution setting unit 10 sets the distribution ratios in such a way that the input power to the second piezoelectric pump 6 is greater than the input power to the first piezoelectric pump 4. As described above, by setting the distribution ratio of input power for the first piezoelectric pump 4 lower, it becomes possible to suppress the temperature increase of the first piezoelectric pump 4 relative to the temperature increase of the second piezoelectric pump 6 and to balance the heat generation of the first piezoelectric pump 4 and the heat generation of the second piezoelectric pump 6. "To balance the heat generation" means that the respective amounts of heat generation of the two pumps are being set in such a way that the maximum temperatures of the two pumps are in equilibrium to each other. In particular, by suppressing an excessive temperature increase in the first piezoelectric pump 4, it becomes possible to suppress the occurrence of failure such as peeling off of the adhesive that bonds metals together in the inside of the pump, cracking of the piezoelectric element, or the like. In this way, the reliability of the pump device 2 can be improved.

Compared with other types of pumps, the piezoelectric pump has a more pronounced heat generating property and is likely to cause a failure due to heat damage. Therefore, by setting the input power in the manner described above and suppressing the heat generation of the first piezoelectric pump 4, it becomes possible to produce the effect of suppressing the occurrence of failure more effectively.

Further, in the present embodiment, the first piezoelectric pump 4 and the second piezoelectric pump 6 have the same rated output. Accordingly, for the input powers to the first piezoelectric pump 4 and the second piezoelectric pump 6, the heat generating properties are at the same level. In such a case, the setting of the input power in the manner described above enables to produce the effect of balancing the heat generation of the first piezoelectric pump 4 and the heat generation of the second piezoelectric pump 6 more effectively.

In the present embodiment, the distribution setting unit 10 sets input current values for the first piezoelectric pump 4 and the second piezoelectric pump 6 in such a way that the input current value for the second piezoelectric pump 6 is greater than the input current value for the first piezoelectric pump 4. In the case of the piezoelectric pumps, the deformation speed of the piezoelectric element is approximately proportional to the current value of input power. Therefore, by setting the distribution ratios of the input current values in the manner described above, it becomes possible to suppressing the occurrence of deformation of the piezoelectric element of the first piezoelectric pump 4. Accordingly, even in the case where the upper-temperature limit of the first piezoelectric pump 4 rises and the temperature of the first piezoelectric pump 4 increases, it is still possible to effectively prevent the failure caused by the deformation of a piezoelectric element.

Note that even in the case where the first piezoelectric pump 4 and the second piezoelectric pump 6 have the same specifications and the same rated output as in the present embodiment, there is a case where actual output performances are different from each other due to manufacturing errors. In such a case, a pump with a lower output performance may be used as the second piezoelectric pump 6, and a pump with a higher output performance may be used as the first piezoelectric pump 4. This enables to suppress the occurrence of failure of the second piezoelectric pump 6 even when a large power is inputted to the second piezoelectric pump 6.

Next, a working example 1 of the embodiment is described.

The working example 1 was used by the inventors of the present disclosure in an experiment regarding the temperature increases of the piezoelectric pumps 4 and 6 using the pump device 2 of the embodiment illustrated in FIG. 1. Conditions and results of the experiment are illustrated in FIG. 2.

In FIG. 2, the column of "AMBIENT TEMPERATURE" represents the temperature in the surroundings of the location where the pump device 2 is placed (unit: ° C.). The temperature of air included in the inside of the suction target 12 illustrated in FIG. 1 is substantially the same as the ambient temperature. The column of "INPUT POWER" is the input power value supplied from the driver unit 8 to each of the first piezoelectric pump 4 and the second piezoelectric pump 6 (unit: W). The column of "TEMPERATURE" is the surface temperature of each of the first piezoelectric pump 4 and the second piezoelectric pump 6 after a lapse of a predetermined time period (in the present embodiment, 5 minutes). The column of "POWER RATIO" is the ratio of the input power supplied to the second piezoelectric pump 6 to the input power supplied to the first piezoelectric pump 4, that is to say, "(input power of the second piezoelectric pump 6)/(input power of the first piezoelectric pump 4)". The column of "CURRENT RATIO" is the ratio of the input current value supplied to the second piezoelectric pump 6 to the input current value supplied to the first piezoelectric pump 4, that is to say, "(input current of the second piezoelectric pump 6)/(input current of the first piezoelectric pump 4)".

Note that both the power ratio and the current ratio are set in advance by the distribution setting unit 10 before operating the pump device 2 and moving air using the first piezoelectric pump 4 and the second piezoelectric pump 6. In the working example 1, the power ratio is changed while maintaining the total value of the input powers at 3.78 W.

The column of "HIGHER OF TWO PUMPS' TEMPERATURES" represents the higher one of the values in the column of "TEMPERATURE" (unit: ° C.). As this temperature decreases, the overall temperature increase of the pump device 2 is suppressed, and the reliability is improved. The column of "FLOW RATE" represents the flow rate of air outputted from the pump device 2, that is to say, the flow rate of air discharged from the first piezoelectric pump 4 (unit: L/min). The column of "PRESSURE" represents the internal pressure of each of the first piezoelectric pump 4 and the second piezoelectric pump 6 after a lapse of a predetermined time period (unit: kPa).

As illustrated in FIG. 2, it is found that there is a correlative relationship between the values of the power ratio and the current ratio and the values of temperatures of the first piezoelectric pump 4 and the second piezoelectric pump 6. Specifically, as the values of the power ratio and the current ratio become greater, the temperature of the first piezoelectric pump 4 decreases while the temperature of the second piezoelectric pump 6 increases.

Furthermore, it is found that there is also a correlative relationship between the values of the power ratio and the current ratio and the higher of the two pumps' temperatures. Specifically, compared with the case where the values of the power ratio and the current ratio are 1, in the case where the values of the power ratio and the current ratio are greater than 1 and equal to or less than a predetermined value, the higher of the two pumps' temperatures becomes lower. This relationship is illustrated in FIG. 3.

Figure 3:
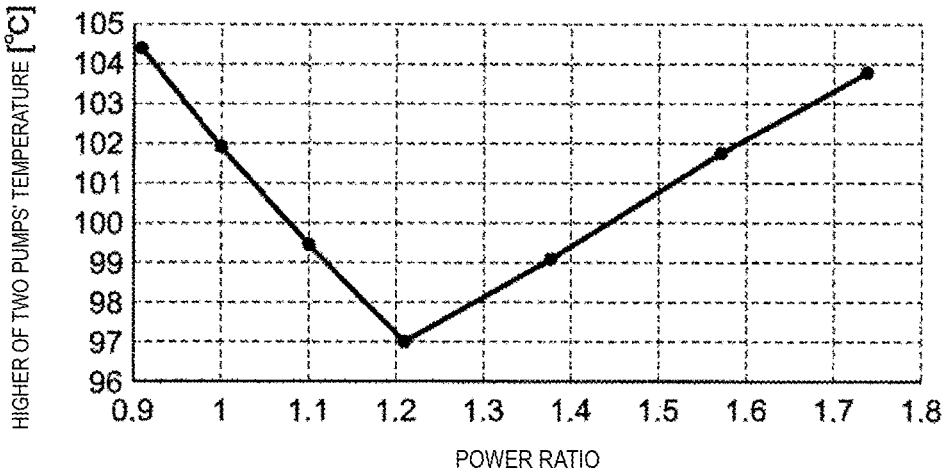
FIG. 3 is a diagram illustrating a relationship between the power ratio and the pump temperature in the working example 1.

In FIG. 3, the horizontal axis represents the power ratio, and the vertical axis represents the higher of the two pumps' temperatures [° C.]. As illustrated in FIG. 3, compared with the case where the value of the power ratio is 1, in the case where the power ratio is set to a value greater than 1 and equal to or less than 1.57, the higher of the two pumps' temperatures is kept lower. With the setting of the power ratio such as this, it becomes possible to effectively suppress the temperature increase of the first piezoelectric pump 4 and to balance the heat generation of the first piezoelectric pump 4 and the heat generation of the second piezoelectric pump 6.

Further, from the result illustrated in FIG. 2, by setting "CURRENT RATIO" to a value greater than 1 and equal to or less than 1.25, it becomes also possible to have advantageous effects similar to those in the case where "POWER RATIO" is set to a value greater than 1 and equal to or less than 1.57. Further, in the case of the piezoelectric pumps, the deformation speed of the piezoelectric element is approximately proportional to the current value of the input power. Therefore, by setting the current ratio in the manner described above, it becomes possible to suppress the deformation of the piezoelectric element of the first piezoelectric pump 4. Accordingly, even in the case where the temperature of the first piezoelectric pump 4 increases, it becomes possible to effectively prevent the failure due to the deformation of the piezoelectric element.

Furthermore, in the case where the power ratio is set to a value between 1.1 and 1.38 inclusive and the current ratio is set to a value between 1.05 and 1.17, the higher of the two pumps' temperatures is further suppressed below a lower temperature. This enables to effectively suppress the temperature increase of the first piezoelectric pump 4 and to balance the heat generation of the first piezoelectric pump 4 and the heat generation of the second piezoelectric pump 6.

As illustrated in FIG. 2, even in the case where the power ratio and the current ratio are varied, the flow rate, which is the output of the pump device 2, is maintained at 0.6 L/min. Further, the value of the internal pressure of the pump varies depending on the magnitude of the input power. The relationship between the pressure and the flow rate in the result of FIG. 2 is described using FIG. 4A, FIG. 4B, FIG. 5A to FIG. 5D, and FIG. 6.

Figure 4A:
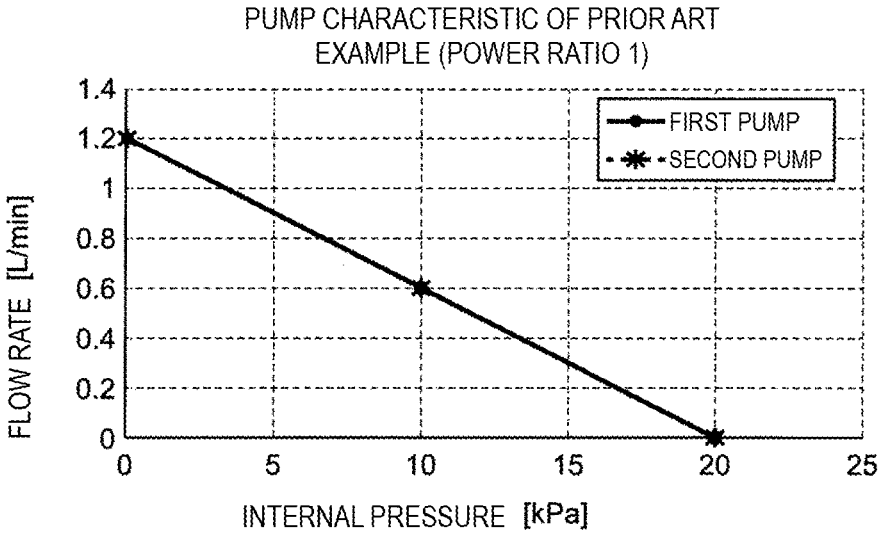
FIG. 4A is a diagram illustrating relationships between the pressure and the flow rate of piezoelectric pumps in the working example 1 (prior art example).
Figure 4B:
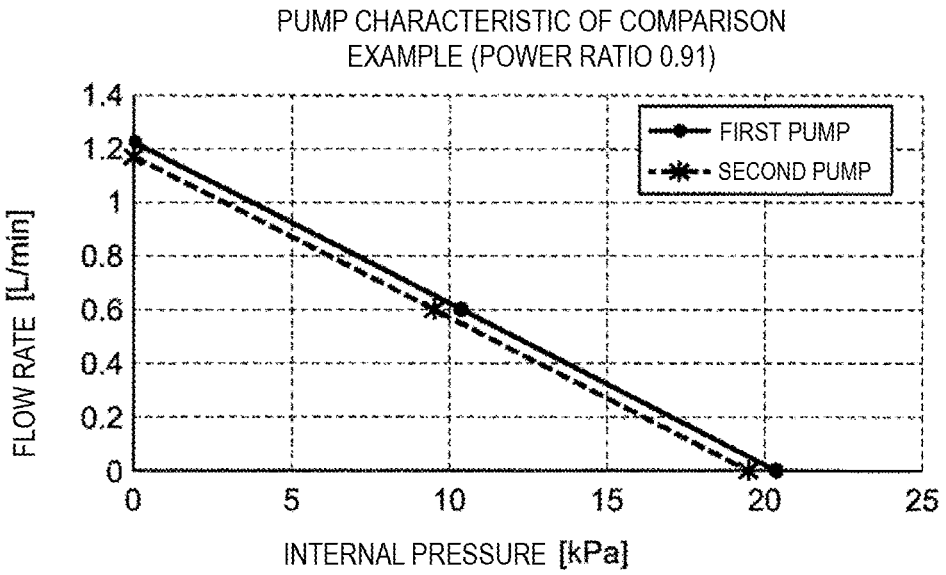
FIG. 4B is a diagram illustrating relationships between the pressure and the flow rate of piezoelectric pumps in the working example 1 (comparison example).
Figure 5A:
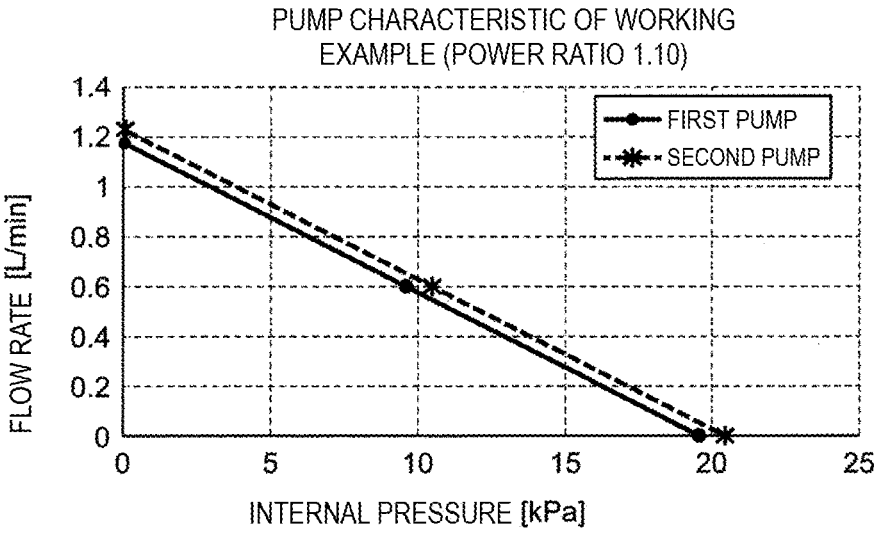
FIG. 5A is a diagram illustrating relationships between the pressure and the flow rate of piezoelectric pumps in the working example 1 (working example).
Figure 5B:
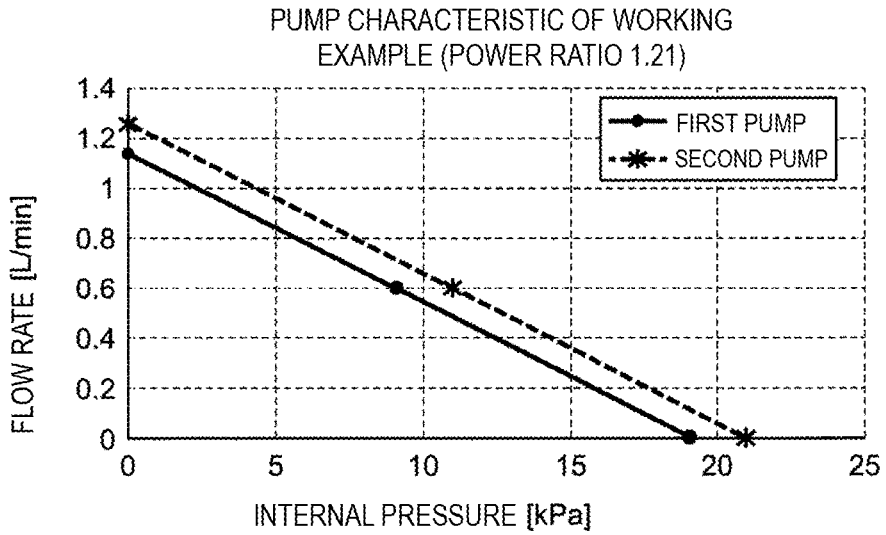
FIG. 5B is a diagram illustrating relationships between the pressure and the flow rate of piezoelectric pumps in the working example 1 (working example).
Figure 5C:
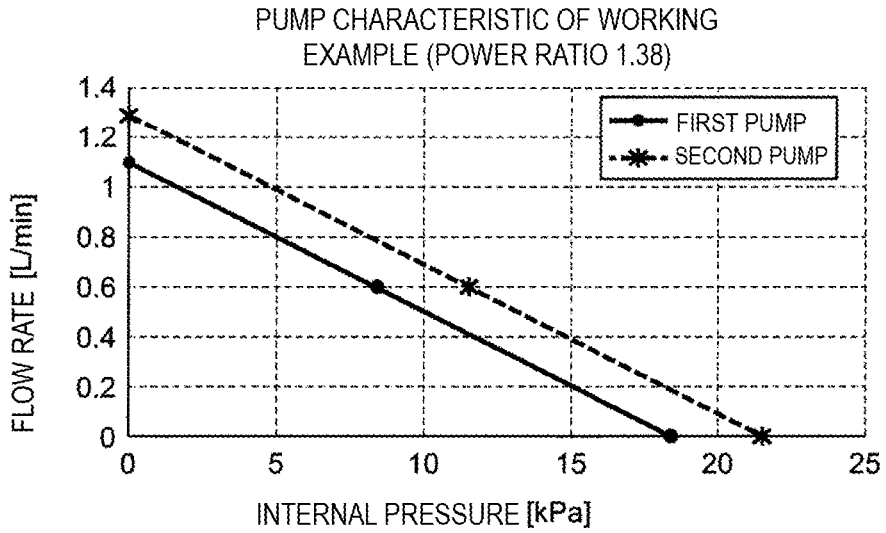
FIG. 5C is a diagram illustrating relationships between the pressure and the flow rate of piezoelectric pumps in the working example 1 (working example).
Figure 5D:
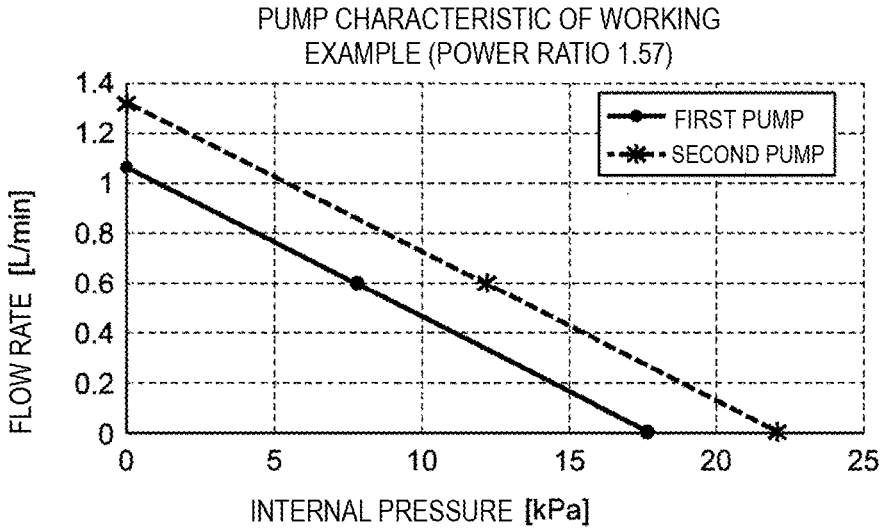
FIG. 5D is a diagram illustrating relationships between the pressure and the flow rate of piezoelectric pumps in the working example 1 (working example).
Figure 6:
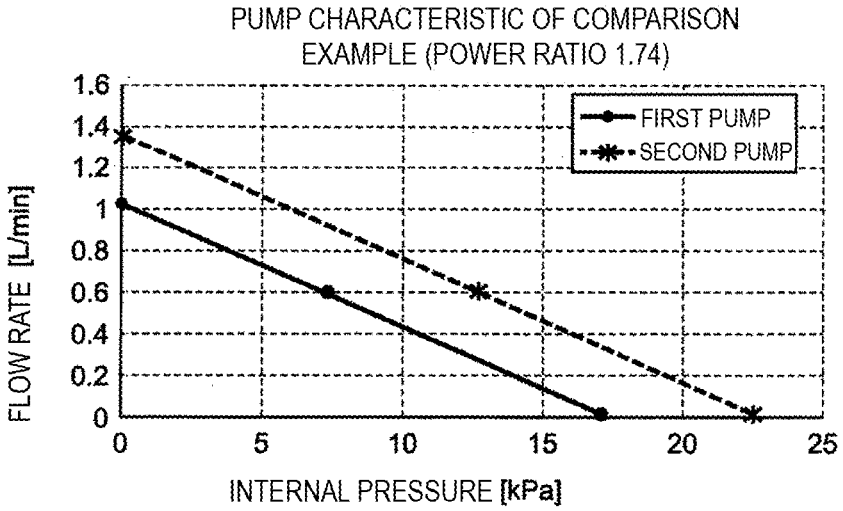
FIG. 6 is a diagram illustrating relationships between the pressure and the flow rate of piezoelectric pumps in the working example 1 (comparison example).

In each of FIG. 4A, FIG. 4B, FIG. 5A to FIG. 5D, and FIG. 6, the horizontal axis represents the internal pressure [kPa] of each pump, and the vertical axis represents the flow rate [L/min] of each pump. FIG. 4A corresponds to a prior art example of power ratio 1, and FIG. 4B corresponds to a comparison example of power ratio 0.91. FIG. 5A to FIG. 5D respectively correspond to working examples. FIG. 5A corresponds to the working example of power ratio 1.10, FIG. 5B corresponds to the working example of power ratio 1.21, FIG. 5C corresponds to the working example of power ratio 1.38, and FIG. 5D corresponds to the working example of power ratio 1.57. FIG. 6 corresponds to a comparison example of power ratio 1.74.

As illustrated in FIG. 4A to FIG. 6, in both the first piezoelectric pump 4 and the second piezoelectric pump 6, the internal pressure of the pump and the flow rate of air being outputted are in the relationship of approximately inverse proportion.

Whatever the value the flow rate is set to, the total value of the pressures is kept at a constant of 20 kPa. For example, when the value of the flow rate is set to 0.6 mL/min, in the case of the power ratio 1 illustrated in FIG. 4A, the internal pressure of the first piezoelectric pump 4 is 10 kPa, and the internal pressure of the second piezoelectric pump 6 is 10 kPa. Similarly, in the case of the power ratio 0.91 of FIG. 4B, the internal pressure of the first piezoelectric pump 4 is 10.5 kPa, and the internal pressure of the second piezoelectric pump 6 is 9.5 kPa. The values of FIG. 5A to FIG. 5D and FIG. 6 are illustrated in FIG. 2, and thus the descriptions thereof are omitted.

As illustrated in the foregoing results, even in the case where the distribution ratio of the input power is varied while keeping the total value of the power ratios at a constant value, the pump device 2 can output air at a constant flow rate while keeping the total value of the internal pressures of the first piezoelectric pump 4 and the second piezoelectric pump 6 at a constant value. In this way, the performance of the pump device 2 can be maintained.

Thus far, the present disclosure is described using the embodiment described above. However, the present disclosure is not limited to the embodiment described above. For example, in the embodiment, the case is described where the distribution setting unit 10 sets the distribution ratio of the "input power". However, the embodiment is not limited to such a case and is also applicable to the case where the distribution setting unit 10 sets the distribution ratio of the "input current value", as described above. Even in such a case, by setting the current ratio illustrated in FIG. 2 to a value greater than 1 and equal to or less than 1.25, it becomes also possible to have advantageous effects similar to those in the case where the power ratio is set to a value greater than 1 and equal to or less than 1.57.

Further, in the embodiment, the case is described where the pump device 2 is used as a negative pressure pump by connecting the second piezoelectric pump 6 to the suction target 12. However, the embodiment is not limited to such a case. For example, the pump device 2 may be used as a booster pump by connecting the exhaust outlet 4*a* of the first piezoelectric pump 4 to a pressurizing target such as cuff or the like, instead of the suction target 12.

Further, in the embodiment, the case is described where two piezoelectric pumps, which are the first piezoelectric pump 4 and the second piezoelectric pump 6, are provided. However, the embodiment is not limited to such a case and may be provided with three or more piezoelectric pumps. In this case, of a plurality of piezoelectric pumps, advantageous effects similar to those of the embodiment may be achieved by setting the input powers of any adjacent piezoelectric pumps in such a way that the input power of the piezoelectric pump on the downstream side is lower than the input power of the piezoelectric pump on the upstream side. Here, there is no need to set the input powers of all the adjacent piezoelectric pumps in the manner described above. Similar advantageous effects may be achieved only by setting the input powers of at least two adjacent piezoelectric pumps in the manner described above.

Further, in the embodiment, the case is described where the two driver units 8A and 8B are provided as the driver unit 8. However, the embodiment is not limited to such a case. Any type of driver unit may be used, provided that the device can drive the two piezoelectric pumps 4 and 6. For example, a single common driver unit may be provided for the two piezoelectric pumps 4 and 6.

With regard to preferred embodiments, the present disclosure is sufficiently described with reference to the accompanying drawings. However, various variations and modifications are apparent to those skilled in the art. It is to be understood that such variations and modifications are included within the scope of the present disclosure, provided that such variations and modifications do not deviate from the scope of the present disclosure described by the attached claims. Furthermore, the combination or order of constituting elements in the respective embodiments may be changed without departing from the scope and spirit of the present disclosure.

The present disclosure is useful for pump devices.

2 Pump device
4 First piezoelectric pump
4*a* Exhaust outlet
6 Second piezoelectric pump
8 Driver unit
8A First driver unit
8B Second driver unit
9 Control device
10 Distribution setting unit
12 Suction target

The invention claimed is:

1. A pump device comprising:
a first piezoelectric pump;
a second piezoelectric pump connected in series to the first piezoelectric pump on an upstream side of the first piezoelectric pump;
a driver unit that supplies alternating-current input power to the first piezoelectric pump and the second piezoelectric pump; and
a distribution setting unit that sets a distribution ratio of the input power supplied from the driver unit to each of the first piezoelectric pump and the second piezoelectric pump, wherein
the distribution setting unit sets a power ratio of the input power for the second piezoelectric pump to the input power for the first piezoelectric pump to a value greater than 1 and equal to or lower than 1.57.

2. The pump device according to claim 1, wherein
the first piezoelectric pump and the second piezoelectric pump have a same rated output.

3. The pump device according to claim 1, wherein
the distribution setting unit sets the power ratio of the input power for the second piezoelectric pump to the input power for the first piezoelectric pump to a value between 1.1 and 1.38 inclusive.

4. The pump device according to claim 2, wherein
the distribution setting unit sets the power ratio of the input power for the second piezoelectric pump to the input power for the first piezoelectric pump to a value between 1.1 and 1.38 inclusive.

5. The pump device according to claim 1, wherein
the driver unit comprises a first driver and a second driver, each configured to supply alternating-current input power to the first piezoelectric pump and the second piezoelectric pump, respectively.

6. The pump device according to claim 1, wherein
the driver unit comprises a single common driver configured to supply alternating-current input power to both the first piezoelectric pump and the second piezoelectric pump.

7. The pump device according to claim 1, further comprising a controller configured to control the driver unit.

8. The pump device according to claim 7, wherein the controller is configured to control at least one of the input power, an input voltage, or an input current inputted from the driver unit to each of the first piezoelectric pump and the second piezoelectric pump.

9. The pump device according to claim 7, wherein the distribution setting unit comprises the controller and the driver unit.

10. A pump device comprising:
a first piezoelectric pump;
a second piezoelectric pump connected in series to the first piezoelectric pump on an upstream side of the first piezoelectric pump;
a driver unit that supplies alternating-current input power to the first piezoelectric pump and the second piezoelectric pump; and
a distribution setting unit that sets a distribution ratio of an input current value supplied from the driver unit to each of the first piezoelectric pump and the second piezoelectric pump, wherein
the distribution setting unit sets a current ratio of the input current value for the second piezoelectric pump to the input current value for the first piezoelectric pump to a value greater than 1 and equal to or lower than 1.25.

11. The pump device according to claim 10, wherein
the distribution setting unit sets the current ratio of the input current value for the second piezoelectric pump to the input current value for the first piezoelectric pump to a value between 1.05 and 1.17 inclusive.

12. The pump device according to claim 10, wherein
the first piezoelectric pump and the second piezoelectric pump have a same rated output.

13. A pump device comprising:
a first piezoelectric pump;
a second piezoelectric pump;
a third piezoelectric pump, wherein the second piezoelectric pump and the third piezoelectric pump are connected in series to the first piezoelectric pump and to the second piezoelectric pump on an upstream side of the first piezoelectric pump and the second piezoelectric pump, respectively;
a driver unit that supplies alternating-current input power to the first piezoelectric pump, the second piezoelectric pump, and the third piezoelectric pump; and
a distribution setting unit that sets a distribution ratio of the input power supplied from the driver unit to the first piezoelectric pump, the second piezoelectric pump, and the third piezoelectric pump,
wherein the distribution setting unit sets a power ratio of the input power of at least two adjacent piezoelectric pumps among the first piezoelectric pump, the second piezoelectric pump, and the third piezoelectric pump such that the input power of any piezoelectric pump on a downstream side is lower than the input power of an adjacent piezoelectric pump on the upstream side.

14. The pump device according to claim 13, wherein the distribution setting unit sets a power ratio of the input power of all two adjacent piezoelectric pumps among the first piezoelectric pump, the second piezoelectric pump, and the third piezoelectric pump such that the input power of any piezoelectric pump on a downstream side is lower than the input power of an adjacent piezoelectric pump on the upstream side.

15. The pump device according to claim 13, wherein
the first piezoelectric pump, the second piezoelectric pump, and the third piezoelectric pump have a same rated output.

16. The pump device according to claim 13, wherein
the driver unit comprises a first driver, a second driver, and a third driver, each configured to supply alternating-current input power to the first piezoelectric pump, the second piezoelectric pump, the third piezoelectric pump, respectively.

17. The pump device according to claim 13, wherein
the driver unit comprises a single common driver configured to supply alternating-current input power to the first piezoelectric pump, the second piezoelectric pump, and the third piezoelectric pump.

18. The pump device according to claim 13, further comprising a controller configured to control the driver unit.

19. The pump device according to claim 18, wherein the controller is configured to control at least one of the input power, an input voltage, or an input current inputted from the driver unit to each of the first piezoelectric pump, the second piezoelectric pump, and the third piezoelectric pump.

20. The pump device according to claim 18, wherein the distribution setting unit comprises the controller and the driver unit.

* * * * *